US007525520B2

(12) United States Patent
Miyazawa

(10) Patent No.: US 7,525,520 B2
(45) Date of Patent: Apr. 28, 2009

(54) ELECTRONIC CIRCUIT, ELECTRO-OPTICAL DEVICE, METHOD OF DRIVING ELECTRO-OPTICAL DEVICE, AND ELECTRONIC APPARATUS

(75) Inventor: Takashi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 444 days.

(21) Appl. No.: 10/665,120

(22) Filed: Sep. 22, 2003

(65) Prior Publication Data

US 2004/0155873 A1 Aug. 12, 2004

(30) Foreign Application Priority Data

Sep. 24, 2002 (JP) ..... 2002-277956
Sep. 8, 2003 (JP) ..... 2003-315584

(51) Int. Cl.
*G09G 3/30* (2006.01)

(52) U.S. Cl. ..... 345/76; 345/82; 315/169.3

(58) Field of Classification Search ..... 345/204, 345/55, 690, 76, 82; 315/169.3
See application file for complete search history.

(56) References Cited

U.S. PATENT DOCUMENTS 5,903,246 A 5/1999 Dingwall
5,952,789 A 9/1999 Stewart et al.
6,091,203 A 7/2000 Kawashima et al.
6,229,506 B1 * 5/2001 Dawson et al. ..... 345/82
6,229,508 B1 5/2001 Kane
6,246,180 B1 6/2001 Nishigaki
6,475,845 B2 11/2002 Kimura
6,501,466 B1 12/2002 Yamagishi et al.
6,693,388 B2 * 2/2004 Oomura ..... 315/169.3
6,781,567 B2 8/2004 Kimura
6,859,193 B1 2/2005 Yumoto
6,956,547 B2 * 10/2005 Bae et al. ..... 345/77
7,081,875 B2 7/2006 Yokoyama et al.
7,193,591 B2 3/2007 Yumoto
7,224,333 B2 5/2007 Yamazaki et al.
7,277,070 B2 10/2007 Koyama
7,317,432 B2 1/2008 Koyama
2002/0027422 A1 * 3/2002 Sempel et al. ..... 315/160
2002/0033783 A1 * 3/2002 Koyama ..... 345/82
2002/0154104 A1 * 10/2002 Inoue et al. ..... 345/204
2002/0171607 A1 * 11/2002 Senda et al. ..... 345/55
2002/0196215 A1 * 12/2002 Tsuchida et al. ..... 345/82
2003/0052614 A1 * 3/2003 Howard ..... 315/169.1
2003/0058195 A1 * 3/2003 Adachi et al. ..... 345/67

(Continued)

FOREIGN PATENT DOCUMENTS

JP A-2000-221942 8/2000

(Continued)

*Primary Examiner*—Amr Awad
*Assistant Examiner*—Stephen G Sherman
(74) *Attorney, Agent, or Firm*—Oliff & Berridge, PLC

(57) ABSTRACT

To an organic EL element of a pixel circuit provided in association with an intersection of a scanning line and a data line, a driving current in accordance with digital data or an analog data current is supplied via the data line. When halftones are controlled by digital gray scale in order to reduce power consumption, digital data having a value corresponding to either a first level or a second level is supplied to the pixel circuit. When halftones are controlled by analog gray scale in order to improve display quality, an analog data current is supplied to the pixel circuit.

29 Claims, 12 Drawing Sheets

U.S. PATENT DOCUMENTS

| | | | | |
|---|---|---|---|---|
| 2003/0098828 | A1 * | 5/2003 | Hunter et al. | 345/76 |
| 2004/0207615 | A1 | 10/2004 | Yumoto | |
| 2005/0190177 | A1 | 9/2005 | Yumoto | |
| 2007/0236427 | A1 | 10/2007 | Koyama | |

FOREIGN PATENT DOCUMENTS

| | | | |
|---|---|---|---|
| JP | A-2001-147659 | | 5/2001 |
| JP | A-2002-162948 | | 6/2002 |
| JP | A-2002-175048 | | 6/2002 |
| JP | A-2002-221936 | | 8/2002 |
| JP | A-2003-280587 | | 10/2003 |
| WO | WO 01/06484 | A1 | 1/2001 |

* cited by examiner

ELECTRONIC CIRCUIT, ELECTRO-OPTICAL DEVICE, METHOD OF DRIVING ELECTRO-OPTICAL DEVICE, AND ELECTRONIC APPARATUS

BACKGROUND OF THE INVENTION

1. Field of Invention

The present invention relates to electronic circuits, electro-optical devices, methods of driving electro-optical devices, and electronic apparatus.

2. Description of Related Art

Recently, interest has arisen in electro-optical devices including organic EL elements. In an electro-optical device of this type, analog gray scale is used as driving method to control halftones of organic EL elements (See e.g., Japanese Unexamined Patent Application Publication No. 2001-147659.). In a method of analog gray scale, a voltage between the source and gate of a driving transistor to supply a current of a current level in accordance with a multi-value data current to an organic EL element is used as a threshold voltage of the driving transistor. According to the method, a current supplied from a DA converter circuit in accordance with a luminance level (data current) is accumulated in a hold capacitor of a pixel circuit. A charge voltage corresponding to the amount of charge accumulated in the hold capacitor is applied to the gate of the driving transistor implemented by a thin-film transistor (TFT). The driving transistor supplies a driving current in accordance with the charge voltage corresponding to the data current to the organic EL element.

In the DA converter circuit that is used in the related art programming method or the like, implementation by thin-film transistors (TFTs) as adopted for the pixel circuit has been difficult due to a problem of precision, so that it has been common to use an external IC driver.

However, a DA converter circuit that is implemented by an external IC driver has had a problem that power consumption is larger compared with a TFT driver circuit that is formed on a display panel.

The present invention has been made in order to address the problem described above and provides an electronic circuit, an electro-optical device, a method of driving an electro-optical device, and an electronic apparatus that allows low power consumption and adequate display quality to be achieved simultaneously.

SUMMARY OF THE INVENTION

A first electronic circuit according to an aspect of the present invention includes an electronic element; a capacitor to accumulate a data signal in a form of an amount of charge; and a first transistor whose conduction state is set in accordance with the amount of charge accumulated in the capacitor, the first transistor supplying an amount of current in accordance with the conduction state to the electronic element; wherein the capacitor is capable of accumulating a data current and a data voltage as the data signal.

Accordingly, a data voltage and a data current are selectively used, allowing representation of halftones in plural ways, for example, digital gray scale and analog gray scale. Thus, for example, for representation of halftones, digital gray scale is selected when low power consumption is a priority while analog gray scale is selected when a high display quality is needed.

In the above electronic circuit preferably, the data current is a multi-value data current, the data voltage is a binary data voltage, and the multi-value data current and the binary data voltage are supplied to the capacitor via a second transistor.

Accordingly, for example, the second switching transistor can be used as a switching transistor when digital gray scale or analog gray scale is exercised, so that the number of transistors in the electronic circuit can be reduced.

In the above electronic circuit, a third transistor may be provided between a gate and a drain of the first transistor.

Accordingly, the third transistor can be used to compensate for variation in characteristics, such as a threshold voltage of the first transistor.

In the above electronic circuit, a fourth transistor may be provided.

More specifically, the fourth transistor determines a timing to start or stop supply of the current to the electronic element after the conduction state of the first transistor is set according to the data signal.

The fourth, transistor may be a transistor disposed, for example, between the first transistor and the electronic element.

Alternatively, the fourth transistor may be a transistor to control conduction between the first transistor and a driving voltage.

Accordingly, a time to supply a current to electronic element can be controlled.

A second electronic circuit according to an aspect of the present invention includes an electronic element; a capacitor that is capable of accumulating a data current and a data voltage as a data signal in a form of an amount of charge; and a first transistor whose conduction state is set in accordance with the amount of charge accumulated in the capacitor, the first transistor supplying an amount of current in accordance with the conduction state to the electronic element; a fifth transistor to reset the amount of charge held in the capacitor to a predetermined state when the fifth transistor is turned on, is provided.

In the above electronic circuit, the electronic element may be an electro-optical element.

In the above electronic circuit, the electronic element may be an EL element.

In the above electronic circuit, the EL element may have a light-emitting layer that is composed of an organic material.

Accordingly, an EL element having a light-emitting layer that is composed of an organic material may be used.

A first electro-optical device according to an aspect of the present invention includes a plurality of scanning lines, a plurality of data lines, and a plurality of unit circuits, a data-voltage outputting circuit to output binary data voltages to the plurality of unit circuits via the plurality of data lines being provided, and a data-current outputting circuit to output data currents to the plurality of unit circuits via the plurality of data lines being provided.

Accordingly, digital gray scale is exercised when a binary data voltage is input from the data-voltage outputting circuit, and analog gray scale is exercised when a multi-value data current is input from the data-current output circuit.

In the above electro-optical device, the data voltages and the data currents may be supplied via common data lines.

Accordingly, an area occupied by wires can be reduced, serving to enhance an aperture ratio.

In the above electro-optical device, the data voltages and the data currents may be supplied via different data lines.

Accordingly, restriction on timing of supplying the data voltage and the data current is alleviated, serving to use time effectively.

A second electro-optical device according to an aspect of the present invention includes a plurality of scanning lines; a plurality of data lines disposed so as to cross the plurality of scanning lines; a plurality of unit circuits provided respectively in association with intersections of the plurality of scanning lines and the plurality of data lines, the plurality of unit circuits driving electro-optical elements in accordance with data signals supplied via the plurality of data lines respectively associated therewith; digital data and analog data being generated as the data signal, and three or more luminances being set using the digital data.

In the above electro-optical device, halftones can be represented in two ways, i.e., digital gray scale and analog gray scale. Accordingly, for example, for representation of halftones, digital gray scale is selected when low power consumption is a priority, and analog gray scale is selected when a high display quality is needed.

In the above electro-optical device, the digital data may be a voltage signal, and the analog data may be a current signal.

In the above electro-optical device, preferably, the digital data is used to set a luminance when the electro-optical device is in a low-power-consumption mode, and the analog data is used to set a luminance when the electro-optical device is in a non-low-power-consumption mode.

In the above electro-optical device, preferably, a luminance level is a binary level of either a first level or a second level when the digital data is supplied to the plurality of unit circuits, and luminance is determined according to an accumulated length of time in which the luminance level is at the first level or the second level within length of a predetermined period.

The first level and the second level are, for example, a luminance level of zero and a luminance level of a predetermined value other than zero.

In the present invention, a "luminance" is determined by a "luminance level" and a length of time for which the "luminance level" is maintained within a predetermined period. For example, the predetermined period may be set in accordance with a temporal resolution of vision of an observer.

In the above electro-optical device, the electro-optical elements may be EL elements.

In the above electro-optical device, each of the EL element may be what is called an organic EL element having a light-emitting layer that is composed of an organic material. Other types of electro-optical elements include, for example, liquid-crystal elements, electrophoresis elements, and electron emission elements.

A third electro-optical device according to an aspect of the present invention includes a display, an image being displayed on the display using a plurality of different gray scale methods.

In the above electro-optical device, preferably, the plurality of gray scale methods is switched between. For example, digital gray scale is selected when low power consumption is a priority, and analog gray scale is selected when a high display quality is a priority.

Alternatively, the gray scale methods may be switched between automatically or manually based on distinction between motion pictures and still pictures.

Yet alternatively, the gray scale methods may be switched between automatically or manually based on an operating environment, such as an ambient brightness.

In a method of driving an electro-optical device including a plurality of scanning lines, a plurality of data lines, and a plurality of unit circuits, each including an electro-optical element, a binary data voltage to allow digital gray scale by the electro-optical element, is generated when the electro-optical device is in a low-power-consumption mode, and a multi-value data current to allow analog gray scale by the electro-optical element is generated when the electro-optical device is in a non-low-power consumption mode.

In a second method of driving an electro-optical device including a plurality of scanning lines, a plurality of data lines, and a plurality of unit circuits, each including an electro-optical element, digital data to allow digital gray scale by the electro-optical element is output to the plurality of data lines when the electro-optical device is in a first display mode, analog data for allowing analog gray scale by the electro-optical element being output to the plurality of data lines when the electro-optical device is in a second display mode.

The first display mode and the second display mode may be switched between by a user, or set in accordance with a type of data signal, an ambient brightness in operation, or the like.

In the above method of driving an electro-optical device, the digital gray scale may allow setting of three or more luminances.

In the above method of driving an electro-optical device, a luminance level in the digital gray scale may be a binary level of either a first level or a second level, and luminance may be determined according to an accumulated length of time in which the luminance level is at the first level or the second level within a predetermined length of period.

That is, what is called time-division gray scale may be employed. Obviously, other digital gray scale methods, such as area gray scale may be employed instead of time-division gray scale.

When the electro-optical device is used, for example, as a display of an electronic apparatus, such as a cellular phone, low power consumption and adequate display quality can be achieved simultaneously.

For example, in a suitable application, a waiting screen for which a high display quality is not needed is displayed using digital gray scale, and an image captured, for example, by a camera function of a cellular phone is displayed using analog gray scale.

Alternatively, digital gray scale and analog gray scale may be switched between based on the remaining amount of battery.

An electronic apparatus according to an aspect of the present invention includes one of the above electro-optical devices.

Accordingly, the electronic apparatus allows low power consumption and adequate display quality to be achieved simultaneously.

DETAILED DESCRIPTION OF EXEMPLARY EMBODIMENTS

First Exemplary Embodiment

A first exemplary embodiment of the present invention will now be described with reference to FIGS. 1 to 5.

Figure 1:
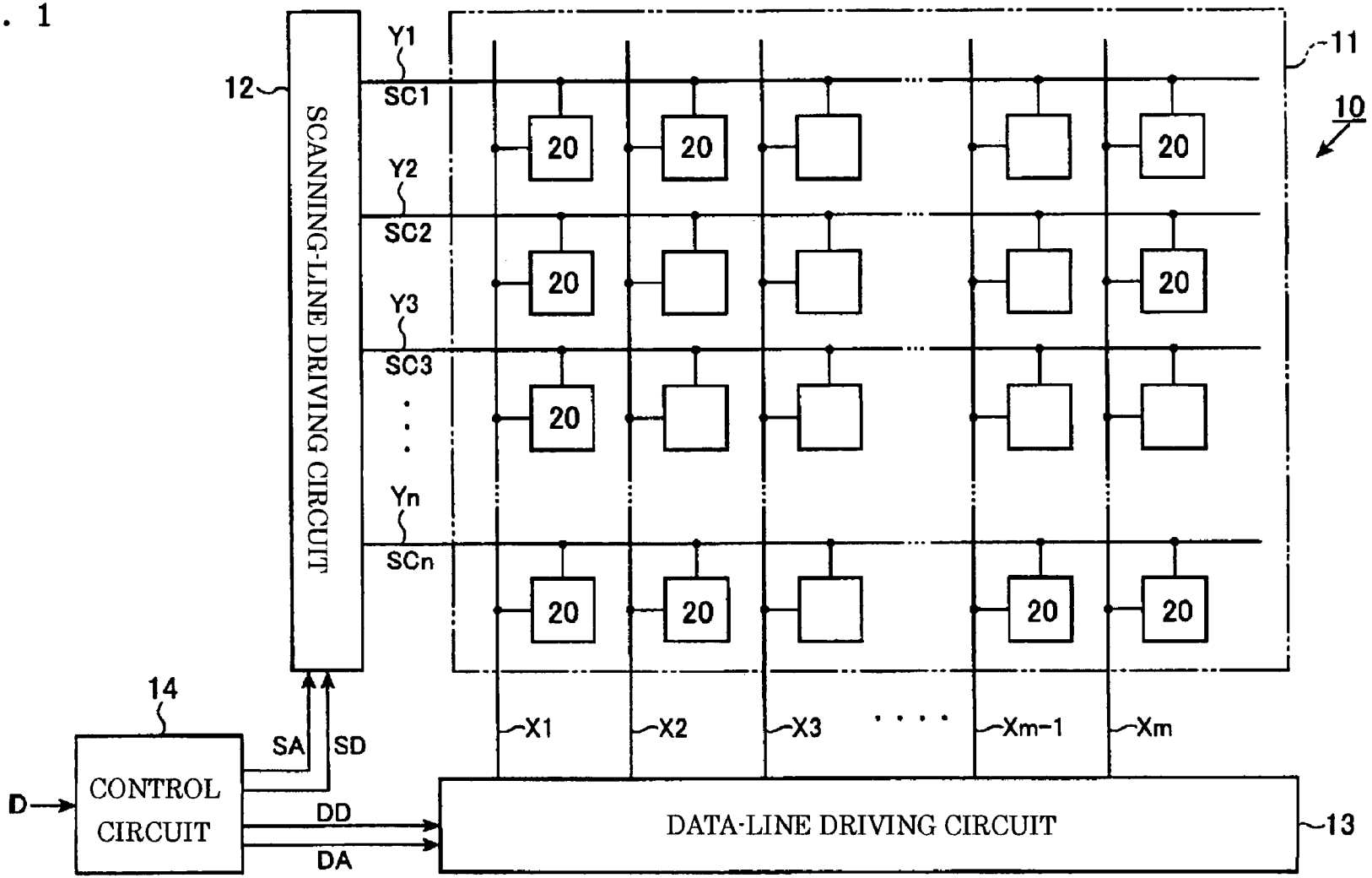
FIG. 1 is a block circuit schematic showing the circuit configuration of an organic EL display for explaining a first exemplary embodiment.

FIG. 1 is a block circuit schematic showing the electrical configuration of an organic EL display 10 as an electro-optical device.

Referring to FIG. 1, the organic EL display 10 includes a display panel 11, a scanning-line driving circuit 12, a data-line driving circuit 13, and a control circuit 14.

The display panel 11, the scanning-line driving circuit 12, the data-line driving circuit 13, and the control circuit 14 of the organic EL display 10 may be implemented by independent electronic components, respectively. For example, the scanning-line driving circuit 12, the data-line driving circuit 13, and the control circuit 14 may be implemented by single-chip semiconductor integrated circuits. Alternatively, part of or the entire display panel 11, scanning-line driving circuit 12, data-line driving circuit 13, and control circuit 14 may be implemented by an integrated electronic component.

For example, the data-line driving circuit 13 and the scanning-line driving circuit 12 may be integrally formed with the display panel 11. Alternatively, part of or the entire scanning-line driving circuit 12, data-line driving circuit 13, and control circuit 14 may be implemented by a programmable IC chip, the functionality of these components being implemented in software by a program written to the IC chip.

As shown in FIG. 1, the display panel 11 includes pixel circuits 20 as a plurality of electronic circuits or unit circuits, arranged in a matrix form. That is, the pixel circuits 20 are disposed in association with intersections of a plurality of (m) data lines X1 to Xm (where m is an integer) extending in a column direction, and a plurality of (n) scanning lines Y1 to Yn (where n is an integer) extending in a row direction.

The control circuit 14, based on an input signal D, generates a first scanning-line-driving-circuit control signal SD to control the scanning-line driving circuit 12 when digital gray scale is exercised, a second scanning-line-driving-circuit control signal SA to control the scanning-line driving circuit 12 when analog gray scale is exercised, a first digital signal DD that is supplied to the data-line driving circuit 13 when digital gray scale is exercised, and a second digital signal DA that is supplied to the data-line driving circuit 13 when analog gray scale is exercised.

In addition to signals regarding gray scale, the input signal D includes, for example, data regarding the remaining amount of battery, ambient brightness, selection signal as to whether a user selects digital mode in which digital gray scale is exercised or analog mode in which analog gray scale is exercised, etc.

Based on the input signal D, either digital gray scale or analog gray scale is selected.

When digital gray scale is exercised, the first digital signal DD is input to the data-line driving circuit 13, and undergoes timing adjustment by latching or the like in the data-line driving circuit 13, whereby the first digital signal DD is converted into digital data VD1 to VDm to be output to the data lines X1 to Xm.

Figure 2:
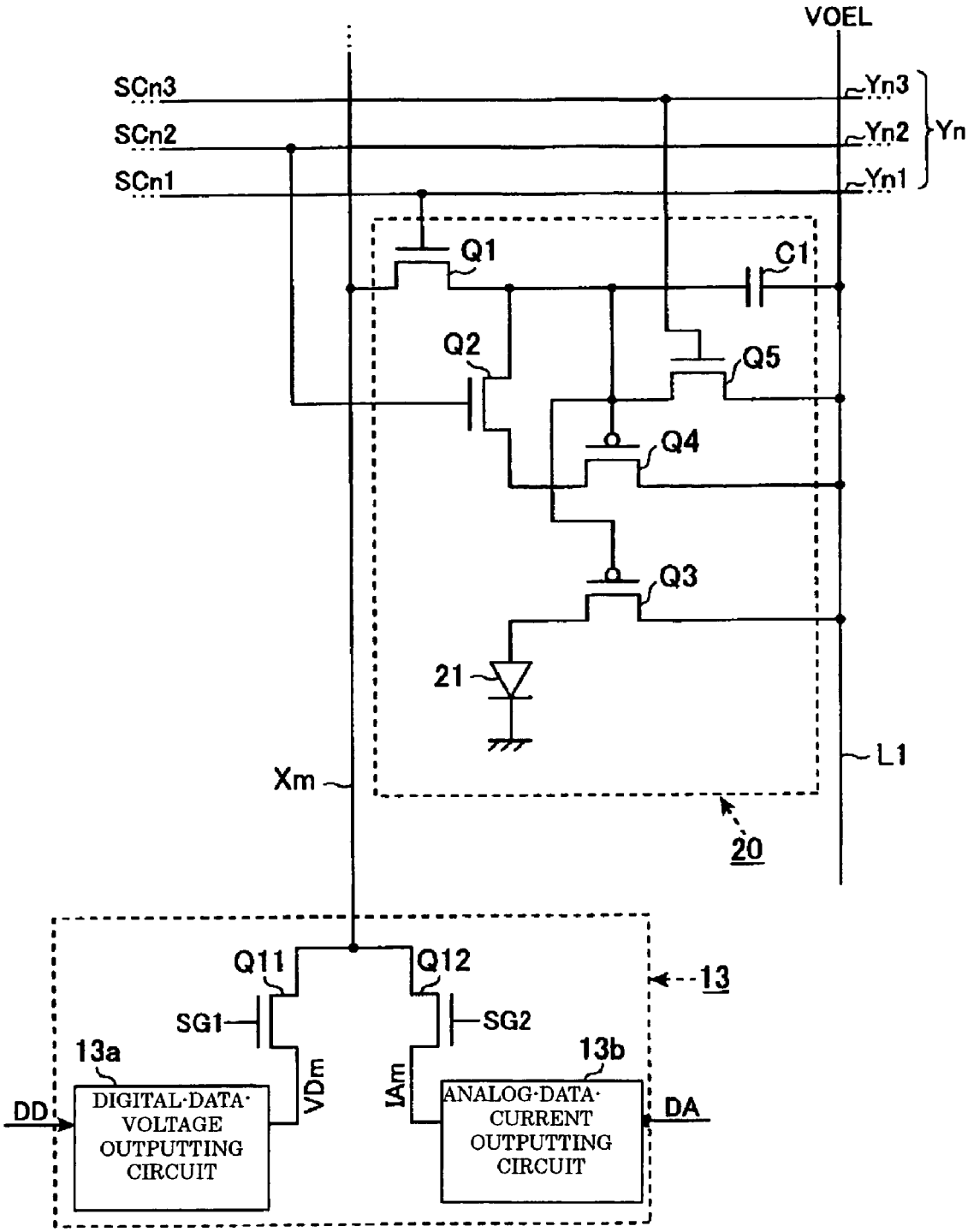
FIG. 2 is a circuit schematic showing the internal circuit configuration of a pixel circuit and a data-line driving circuit.

The timing adjustment, etc. mentioned above, is executed in a digital-data-voltage outputting circuit 13*a* shown in FIG. 2, included in the data-line driving circuit 13.

When analog gray scale is exercised, the second digital signal DA is input to the data-line driving circuit 13, and undergoes digital-to-analog conversion in the data-line driving circuit 13, whereby the second digital signal DA is converted into analog data currents IA1 to IAm to be output to the data lines X1 to Xm.

The processing including digital-analog conversion mentioned above is executed in an analog-data-current outputting circuit 13*b* shown in FIG. 2, included in the data-line driving circuit 13.

As shown in FIG. 2, each of the pixel circuits 20 includes an organic EL element 21 (refer to FIG. 2) having a light-emitting layer composed of an organic material. Transistors provided in the pixel circuit 20 are usually implemented by thin-film transistors (TFTs).

The pixel circuit 20 includes a first switching transistor Q1, a second switching transistor Q2, a driving transistor Q3, a converting transistor Q4, a resetting transistor Q5, and a hold capacitor C1 as a capacitor.

The first and second switching transistors Q1 and Q2 and the resetting transistor Q5 are implemented by N-channel transistors. The driving transistor Q3 and the converting transistor Q4 are implemented by a P-channel transistor.

The drain of the driving transistor Q3 is connected to the anode of the organic EL element 21, and the source thereof is connected to a power-supply line L1. To the power-supply line L1, a power-supply voltage VOEL to drive the organic EL element 21 is supplied.

The gate of the driving transistor Q3 is connected to a first end of the hold capacitor C1, and the first end of the hold capacitor C1 is connected to the data line Xm via the first switching transistor Q1.

To the other end of the hold capacitor C1, the power-supply voltage VOEL is applied via the power-supply line L1. The gate of the driving transistor Q3 is connected to the gate of the converting transistor Q4. To the source of the converting transistor Q4, the power-supply voltage VOEL is applied via the power-supply line L1.

The second switching transistor Q2 is connected between the gate and drain of the converting transistor Q4. The drain of the converting transistor Q4 is connected to the data line Xm via the second switching transistor Q2 and the first switching transistor Q1.

The gate of the first switching transistor Q1 is connected to a first sub-scanning line Yn1 of the scanning line Yn, and it receives a first scanning signal SCn1 via the first sub-scanning line Yn1.

The gate of the second switching transistor Q2 is connected to a second sub-scanning line Yn2 of the scanning line Yn, and it receives a second scanning signal SCn2 via the second sub-scanning line Yn2.

The conductions of the first switching transistor Q1 and the second switching transistor Q2 are controlled based on the first scanning signal SCn1 and the second scanning signal SCn2, respectively, as will be described later.

The resetting transistor Q5 is connected between the terminals of the hold capacitor C1. The gate of the resetting transistor Q5 is connected to a third sub-scanning line Yn3 of the scanning line Yn, and it receives a third scanning signal SCn3 via the third sub-scanning line Yn3.

When the resetting transistor Q5 is turned on based on the third scanning signal SCn3, the power-supply voltage VOEL, supplied via the power-supply line L1, is applied to the first end of the hold capacitor C1 via the resetting transistor Q5. When the power-supply voltage VOEL is applied to the first end of the hold capacitor C1, the hold capacitor C1 is reset, whereby the driving transistor Q3 is turned off.

The connections of the digital-data-voltage outputting circuit 13*a* and the analog-data-current outputting circuit 13*b* with the data line Xm are controlled by a first switch Q11 and a second switch Q12, respectively.

When digital gray scale is exercised, the first switch Q11 is turned on. On the other hand, when analog gray scale is exercised, the second switch Q12 is turned on. Thus, when digital gray scale is exercised in the organic EL display 10, the digital data VDm is output to the data line Xm. On the other hand, when analog gray scale is exercised, the analog data current IAm is output to the data line Xm.

Now, time-division gray scale that is employed for exercising digital gray scale in this exemplary embodiment will be described with reference to FIG. 3.

Figure 3:
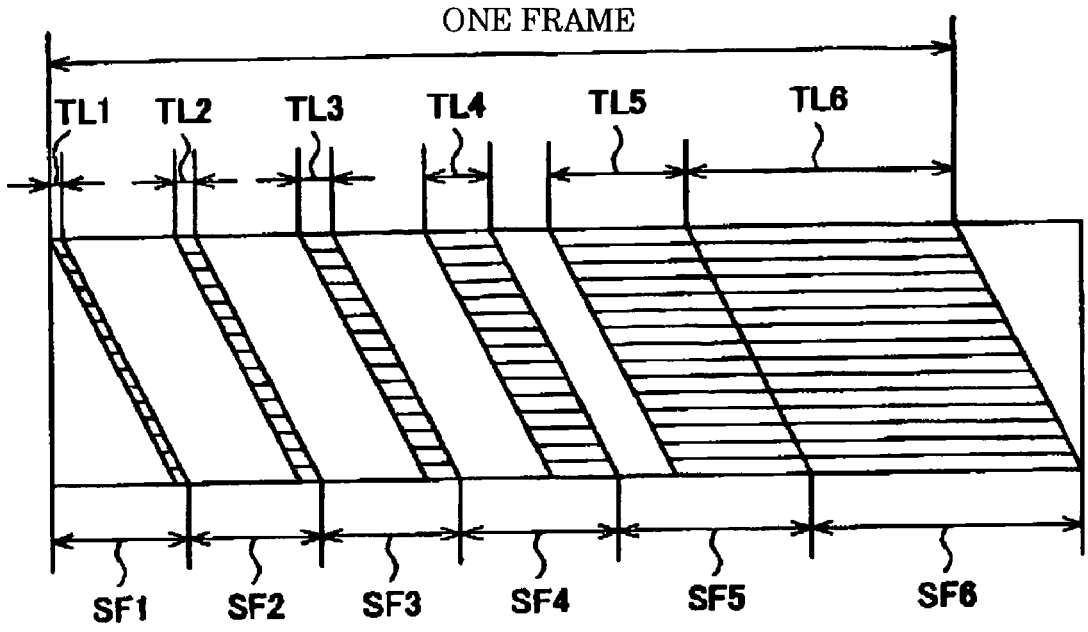
FIG. 3 is a schematic for explaining sequential turning-on and simultaneous resetting in time-division gray scale.

As shown in FIG. 3, scanning to display a single screen (one frame) is divided into six sub-frames SF1 to SF6. In each of the sub-frames SF1 to SF6, the organic EL element 21 is set either to cause light emission or not to cause light emission. Each of the sub-frames SF1 to SF6 is terminated by a resetting operation.

The sub-frames SF1 to SF6 have light-emitting periods (light-emitting times) TL1 to TL6, respectively, and the light-emitting periods TL1 to TL6 are set such that:

TL1:TL2:TL3:TL4:TL5:TL6=1:2:4:8:16:32

As an example, a luminance of "7" can be achieved by causing the organic EL element 21 to emit light in the first to third sub-frames SF1 to SF3, while not to emit light in the fourth to sixth sub-frames SF4 to SF6.

As another example, a luminance of "32" can be achieved by causing the organic EL element 21 to emit light in the sixth sub-frame SF6, while not to emit light in the first to the fifth sub-frames SF1 to SF5.

By causing the organic EL element 21 selectively to emit light or not to emit light in each of the sub-frames SF1 to SF6 as described above on a frame-by-frame basis, halftones can be achieved.

Figure 4:
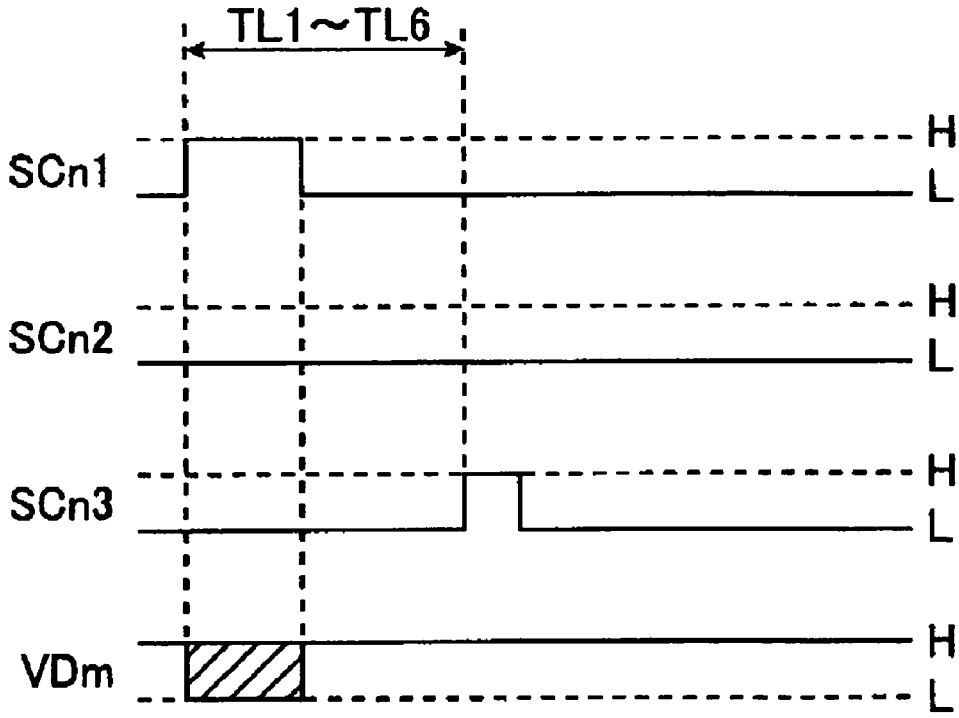
FIG. 4 is a timing chart for explaining selection of a scanning line for exercising time-division gray scale.

Time-division gray scale in this exemplary embodiment will now be described in more detail with reference to FIG. 4. First, the first scanning signal SCn1 is pulled to H level, whereby the first switching transistor Q1 is turned on. In response, binary digital data VDm is supplied to the hold capacitor C1 via the first switching transistor Q1, whereby an amount of charge corresponding to the binary digital data VDm is accumulated in the hold capacitor C1. At this time, the resetting transistor Q5 is kept turned off.

Since the driving transistor Q3 is a P-channel transistor, the organic EL element 21 is caused to emit light when the binary digital data VDm is at L level while the organic EL element 21 is caused not to emit light when the binary digital data VDm is at H level.

The charge accumulated in the hold capacitor C1, corresponding to the binary digital data VDm, is reset by turning on the resetting transistor Q5 and thereby supplying the power-supply voltage VOEL to the hold capacitor C1. This is the resetting operation mentioned earlier.

In this exemplary embodiment, the second switching transistor Q2, which controls electrical connection between the drain and gate of the converting transistor Q4, is kept turned off when time-division gray scale is being exercised.

The resetting operation can be executed without using the resetting transistor Q5. That is, when the second switching transistor Q2 is turned on, an electrical connection is formed between the gate and drain of the driving transistor Q3, so that a voltage (VOEL—Vth) obtained by subtracting a threshold voltage of the driving transistor Q3 from the power-supply voltage is applied to the gate of the driving transistor Q3, whereby the driving transistor Q3 is turned off.

Between the driving transistor Q3 and the organic EL element 21, a period-controlling transistor to control conduction between the driving transistor Q3 and the organic EL element 21 may be provided. In that case, the lengths of periods when the period-controlling transistor is on and off are controlled in accordance with a desired luminance, so that a data signal need not be supplied in each sub-frame.

Preferably, the binary values of the voltage data are set, for example, correspondingly to a minimum value and a maximum value of resistance of the driving transistor Q3, respectively, that is, correspondingly to a minimum value and a maximum value of the luminance of the organic EL element 21.

When the driving transistor Q3 is implemented by a thin-film transistor, the saturation region is not necessarily clear. In that case, the binary values of the voltage data may be set correspondingly to a lower limit and an upper limit of a desired range of luminance.

Analog gray scale is exercised by the pixel circuit 20 in the following manner.

Figure 5:
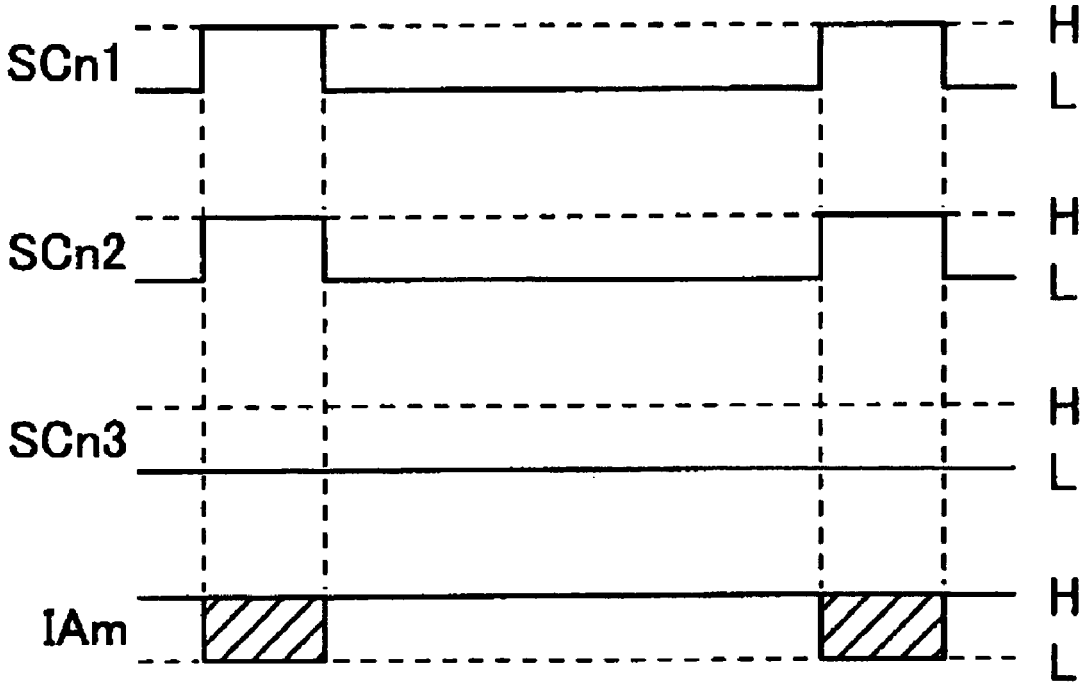
FIG. 5 is a timing chart for explaining selection of a scanning line for exercising analog gray scale.

As shown in FIG. 5, the first and second switching transistors Q1 and Q2 are both turned on, whereby an analog data current IAm passes through the converting transistor Q4. Thus, the hold capacitor C1, connected to the gate of the converting transistor Q4, holds an amount of charge corresponding to the analog data current IAm. Accordingly, the driving transistor Q3, to the gate of which the hold capacitor C1 is connected, is set to a conduction state in accordance with the analog data current IAm.

A current in accordance with the conduction state of the driving transistor Q3, set in the above process, is supplied to the organic EL element 21, causing emission of light.

In this exemplary embodiment, when analog gray scale is exercised, the resetting transistor Q5 is kept turned off. Thus, a period from a time when an analog data current IAm is supplied to the pixel circuit 20 to a time when an analog data current IAm is supplied to the pixel circuit next time constitutes a light-emitting period.

When analog gray scale is exercised, similarly to the case of digital gray scale described earlier, a resetting operation may be performed. For example, the resetting operation may be the same as that for digital gray scale described earlier.

By performing a resetting operation for analog gray scale as well, characteristics of moving pictures can be enhanced and time to write analog data can be reduced.

Second Exemplary Embodiment

Next, a second exemplary embodiment will be described with reference to FIG. 6. This exemplary embodiment is characterized by a pixel circuit 20, so that only the pixel circuit 20 will be described for convenience of description.

Figure 6:
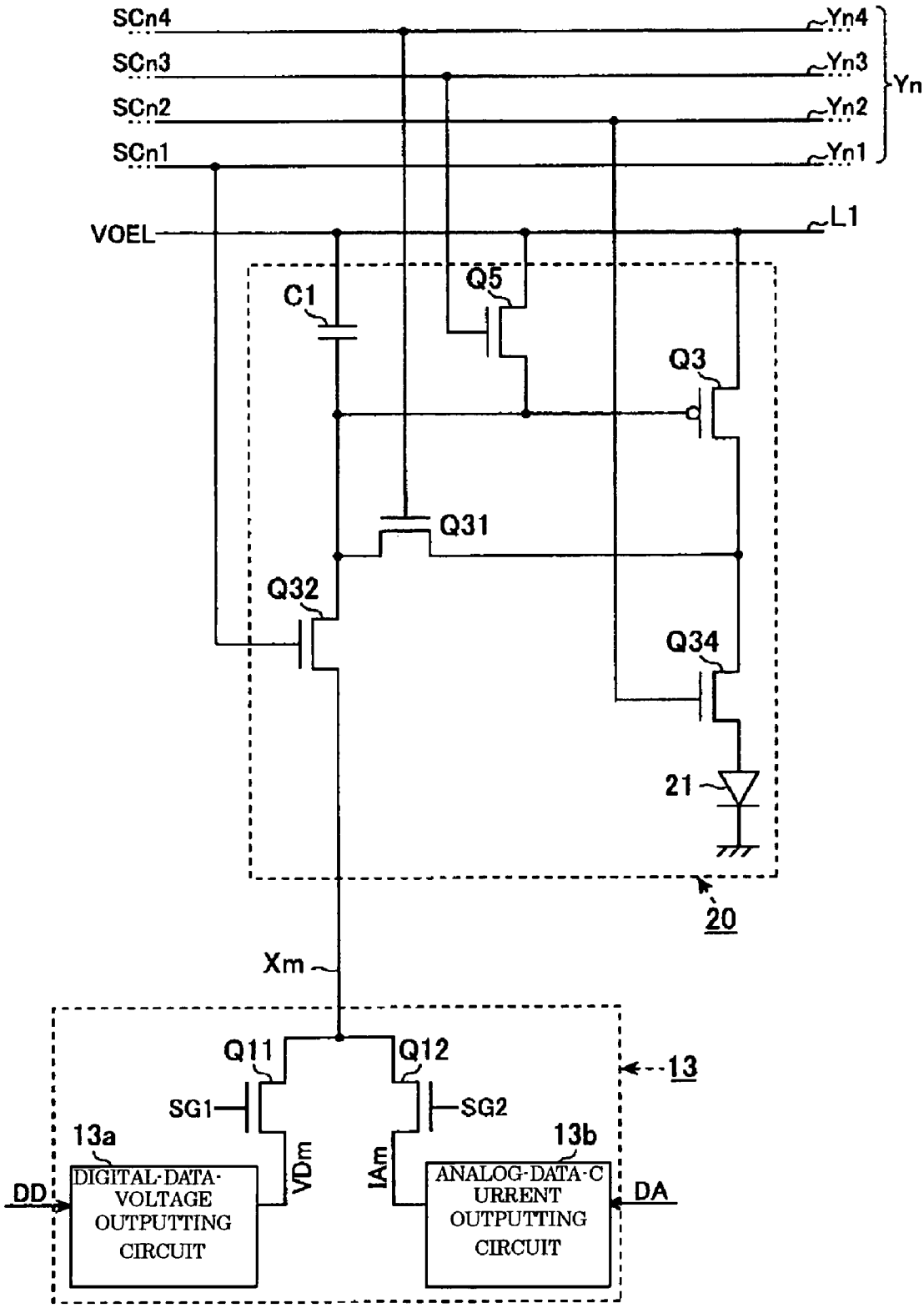
FIG. 6 is a circuit schematic for explaining the internal circuit configurations of a pixel circuit and a data-line driving circuit for explaining a second exemplary embodiment.

Referring to FIG. 6, the pixel circuit 20 includes a driving transistor Q3, first and second switching transistors Q31 and Q32, a period-controlling transistor Q34, a resetting transistor Q5, and a hold capacitor C1.

The driving transistor Q3 is implemented by a P-channel transistor. The first and second switching transistors Q31 and Q32, the period-controlling transistor Q34, and the resetting transistor Q5 are implemented by N-channel transistors.

The drain and source of the driving transistor Q3 are connected to a pixel electrode of an organic EL element 21 and a power-supply line L1 via the period-controlling transistor Q34, respectively. To the power-supply line L1, a power-supply voltage VOEL to drive the organic EL element 21 is supplied.

The hold capacitor C1 is connected between the driving transistor Q3 and the power-supply line L1. Furthermore, the resetting transistor Q5 is connected between the gate of the driving transistor Q3 and the power-supply line L1. Furthermore, the gate of the driving transistor Q3 is connected to a data line Xm via the first switching transistor Q31.

The drain of the driving transistor Q3 is connected to the drain of the second switching transistor Q32, and is electrically connected to the data line Xm via the first switching transistor Q31 and the second switching transistor Q32.

The gate of the first switching transistor Q31 is connected to a fourth sub-scanning line Yn4 of a scanning line Yn, and is controlled according to a fourth scanning signal SCn4 that is supplied via the fourth sub-scanning line Yn4.

The gate of the second switching transistor Q32 is connected to a first sub-scanning line Yn1 of the scanning line Yn, and is controlled according to a first scanning signal SCn1 that is supplied via the first sub-scanning line Yn1.

The gate of the period-controlling transistor Q34 is connected to a second sub-scanning line Yn2 of the scanning line Yn, and it receives a second scanning signal SCn2 that is supplied via the second sub-scanning line Yn2. When the period-controlling transistor Q34 is turned on, the driving transistor Q3 becomes electrically connected to the organic EL element 21, whereby a current in accordance with a conduction state of the driving transistor Q3 is supplied to the organic EL element 21.

The gate of the resetting transistor Q5 is connected to a third sub-scanning line Yn3 of the scanning line Yn, and is controlled according to third scanning signal SCn3 that is supplied via the third sub-scanning line Yn3.

When the resetting transistor Q5 is turned on, the power-supply line L1 becomes electrically connected to the gate of the driving transistor Q3 via the resetting transistor Q5, whereby the power-supply voltage VOEL is applied to the gate of the driving transistor Q3. Thus, the hold capacitor C1 is reset, and the driving transistor Q3 is turned off.

In the pixel circuit 20 configured as described above, time-division gray scale is exercised in the following manner.

Figure 7:
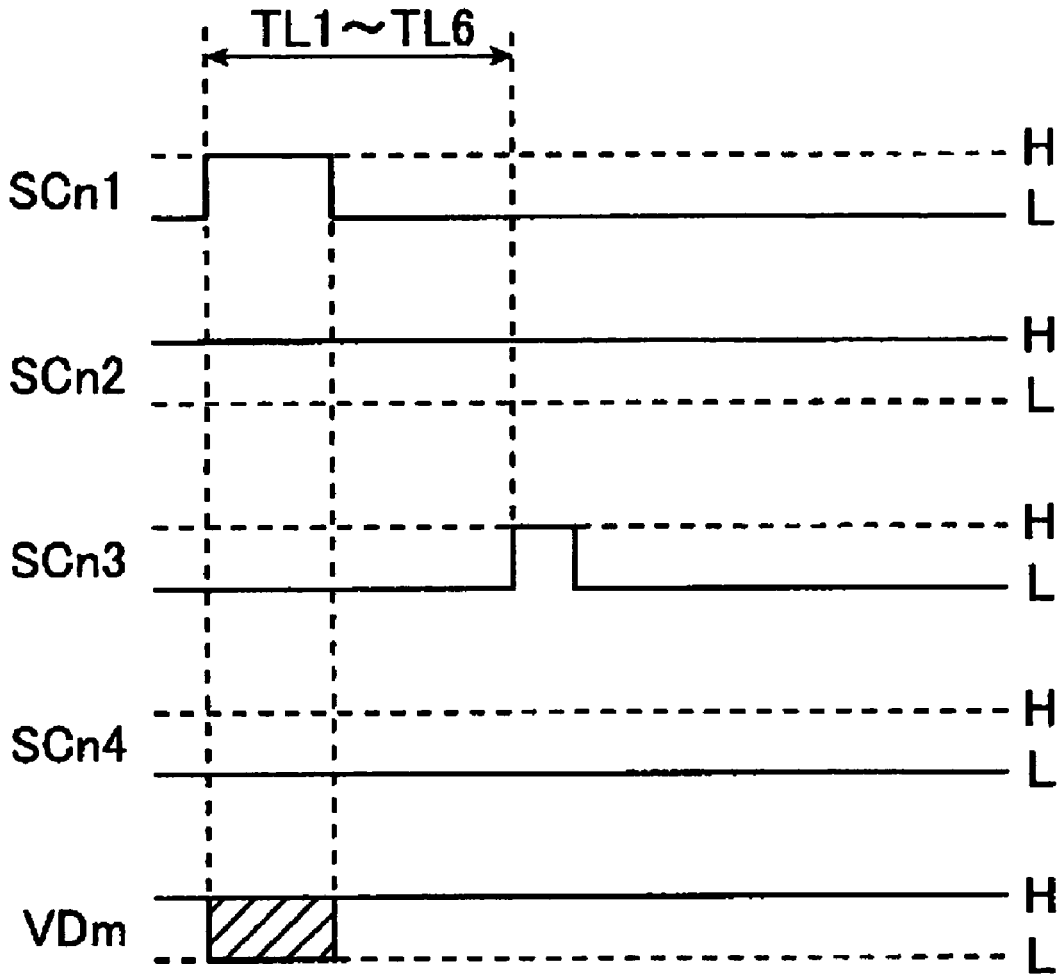
FIG. 7 is a timing chart for explaining selection of a scanning line for exercising time-division gray scale in the second embodiment.

Referring to FIG. 7, in the sub-frames SF1 to SF6, the period-controlling transistor Q34 is kept turned on based on a second scanning signal SCn2 at H level, and the resetting transistor Q5 is kept turned off based on a third scanning signal SCn3 at L level. In this state, the second switching transistor Q32 is turned on based on a first scanning signal SCn1 at H level.

When the second switching transistor Q32 is turned on, digital data VDm is supplied to the hold capacitor C1 via the data line Xm. The digital data VDm is binary data to set either a minimum value or a maximum value (or a lower limit and an upper limit) of the luminance of the organic EL element 21 similarly to the exemplary embodiment described earlier, i.e., binary data to set the resistance of the driving transistor Q3 to either a minimum value or a maximum value.

The driving transistor Q3 is controlled so as to be turned on or off based on the digital data VDm accumulated. When the driving transistor Q3 is on, a driving current is supplied to the organic EL element 21, causing emission of light. On the other hand, when the driving transistor Q3 is off, a driving current is not supplied to the organic EL element 21.

Then, when the third scanning signal SCn3 is output to the third sub-scanning line Yn3 at a timing based on the sub-frames SF1 to SF6, the resetting transistor Q5 that has been off is now turned on. When the resetting transistor Q5 is turned on, the power-supply voltage VOEL is applied from the power-supply line L1 to the hold capacitor C1 via the resetting transistor Q5, whereby the digital data VDm mentioned earlier is deleted and the driving transistor Q3 is turned off.

Thus, light emission by the organic EL element 21 stops, and the current sub-frames are terminated. Then, a light-emitting operation to be executed next is waited for. That is, when time-division gray scale is exercised, the light-emitting periods TL1 to TL6 of the organic EL element 21 of the pixel circuit 20 correspond to a period from a time when the first scanning signal SCn1 is output to a time when the third scanning signal SCn3 is output.

Figure 8:
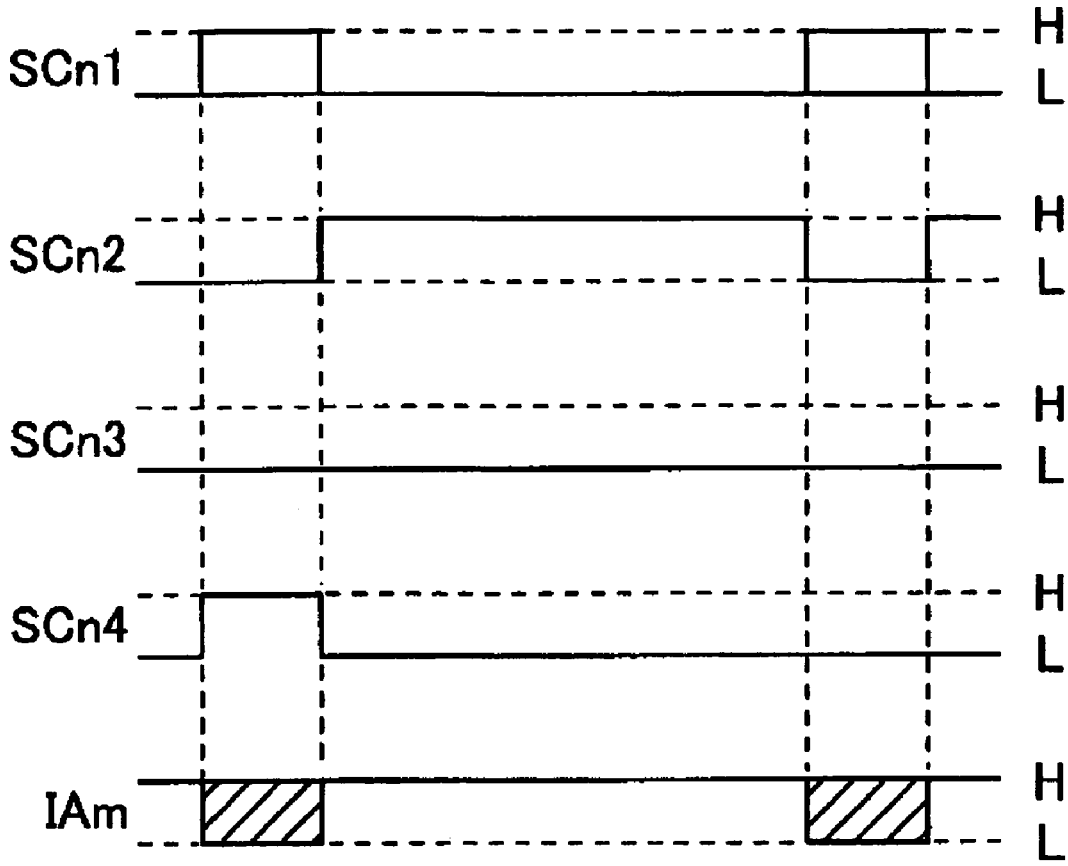
FIG. 8 is a timing chart for explaining selection of a scanning line for exercising analog gray scale in the second embodiment.

In the pixel circuit 20, analog gray scale is exercised in the following manner to control the conduction state of the driving transistor Q3 in accordance with a desired luminance so that a current having a current level in accordance with a multi-value data current will be supplied to the organic EL element 21. Referring to FIG. 8, the first and second switching transistors Q31 and Q32 and the period-controlling transistor Q34 are controlled so as to be turned on and off at prescribed timings, whereby analog gray scale is exercised. At this time, the resetting transistor Q5 is kept turned off.

More specifically, when a first scanning signal SCn1 and a fourth scanning signal SCn4 at H level are supplied to the first sub-scanning line Yn1 and the fourth sub-scanning signal Yn4, respectively, the first and second switching transistors Q31 and Q32 are both turned on. Thus, an analog data current IAm is supplied from the data line Xm via the first and second switching transistors Q31 and Q32.

At this time, the analog data current IAm passes through the driving transistor Q3. Thus, an amount of charge corresponding to the analog data current LAm is held in the hold capacitor C1, connected to the gate of the driving transistor Q3, whereby the conduction state of the driving transistor Q3 is set accordingly.

Then, when the period-controlling transistor Q34 is turned on in response to the second scanning signal SCn2, a driving current in accordance with the conduction state of the driving transistor Q3, set in accordance with the analog data current IAm, is supplied to the organic EL element 21. The organic EL element 21 emits light at a luminance level that is determined based on the driving current supplied thereto.

As described above, according to this exemplary embodiment, similarly to the first exemplary embodiment described earlier, for example, halftones are represented by digital gray scale when multi-level display is not needed, such as when displaying text or the like, and halftones are represented by analog gray scale when multi-level display is needed, such as when displaying an animation or movie. That is, halftones are represented by digital gray scale with low power consumption when a high display quality is not needed, and halftones are represented by analog gray scale when a high display quality is needed. Accordingly, the organic EL display 10 simultaneously achieves low power consumption and a high display quality.

Furthermore, according to the second exemplary embodiment, digital data VD1 to VDm and analog data current IA1 to IAm are supplied to the pixel circuit 20 via the common data lines X1 to Xm, respectively, so that the number of wires provided in the display panel 11 is reduced.

In this exemplary embodiment, the resetting transistor Q5 is constantly kept turned off in analog gray scale mode. Alternatively, the resetting transistor Q5 may be turned on before writing analog data currents IA1 to LAm, thereby terminating a light-emitting period.

Third Exemplary Embodiment

Next, a third exemplary embodiment will be described with reference to FIG. 9. Since this exemplary embodiment is characterized by a pixel circuit 20, only the pixel circuit 20 will be described for convenience of description.

Figure 9:
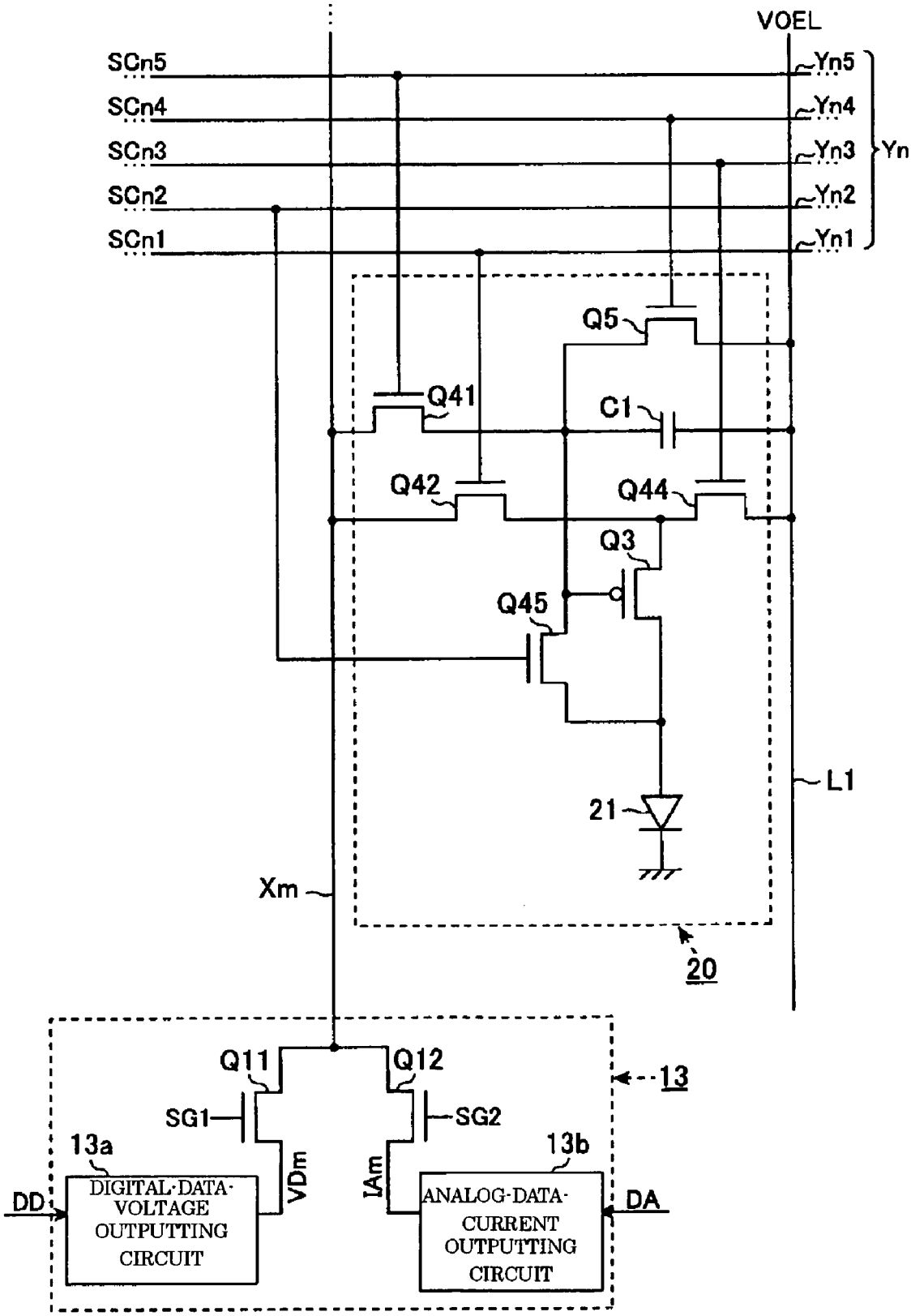
FIG. 9 is a circuit schematic for explaining the internal circuit configurations of a pixel circuit and a data-line driving circuit for explaining a third exemplary embodiment.

Referring to FIG. 9, the pixel circuit 20 includes a driving transistor Q3, first and second switching transistors Q41 and Q42, a period-controlling transistor Q44, a compensating transistor Q45 as a third transistor, a resetting transistor Q5, and a hold capacitor C1. The driving transistor Q3 is implemented by a P-channel transistor. The first and second switching transistors Q41 and Q42, the period-controlling transistor Q44, the compensating transistor Q45, and the resetting transistor Q5 are implemented by N-channel transistors.

The drain of the driving transistor Q3 is connected to a pixel electrode of an organic EL element 21, and the source thereof is connected to a power-supply line L1 via the period-controlling transistor Q44. To the power-supply line L1, a power-supply voltage VOEL to drive the organic EL element 21 is supplied. The gate of the driving transistor Q3 and the power-supply line L1 are connected to the hold capacitor C1. Furthermore, the resetting transistor Q5 is connected between the gate of the driving transistor Q3 and the power-supply line L1.

Furthermore, the gate of the driving transistor Q3 is connected to a data line Xm via the first switching transistor Q41. Furthermore, the source of the driving transistor Q3 is connected to the data line Xm via the second switching transistor Q42. The compensating transistor Q45 is connected between the gate and drain of the driving transistor Q3.

The gate of the first switching transistor Q41 is connected to a fifth sub-scanning line Yn5 of a scanning line Yn, and it receives a fifth scanning signal SCn5 via the fifth sub-scanning line Yn5. When the first switching transistor Q41 is turned on, based on the fifth scanning signal SCn5, digital data VDm supplied via the data line Xm is supplied to the hold capacitor C1 via the first switching transistor Q41.

The gate of the second switching transistor Q42 is connected to a first sub-scanning line Yn1 of the scanning line Yn, and it receives first scanning signal SCn1 via the first sub-scanning line Yn1. When the second switching transistor Q42 is turned on based on the first scanning signal SCn1, an analog data current IAm supplied via the data line Xm passes through the second switching transistor Q42. At this time, if the compensating transistor Q45 is on, an electrical connection is formed between the drain and gate of the driving transistor Q3, whereby an amount of charge corresponding to the analog data current IAm is accumulated in the hold capacitor C1.

The gate of the period-controlling transistor Q44 is connected to a third sub-scanning line Yn3 of the scanning line Yn, and it receives a third scanning signal SCn3 via the third sub-scanning line Yn3. When the period-controlling transistor Q44 is turned on based on the third scanning signal SCn3, a driving current in accordance with a conduction state of the driving transistor Q3 is supplied to the organic EL element 21.

The gate of the resetting transistor Q5 is connected to a fourth sub-scanning line Yn4 of the scanning line Yn, and it receives a fourth scanning signal SCn4 via the fourth sub-scanning line Yn4. When the resetting transistor Q5 is turned on based on the fourth scanning signal SCn4, the power-supply voltage VOEL supplied via the power-supply line L1 is applied to a first end of the hold capacitor C1 via the resetting transistor Q5. When the power-supply voltage VOEL is applied to the first end of the hold capacitor C1, the hold capacitor C1 is reset, whereby the driving transistor Q3 is turned off.

In the pixel circuit 20 configured as described above, time-division gray scale is exercised in the following manner.

Figure 10:
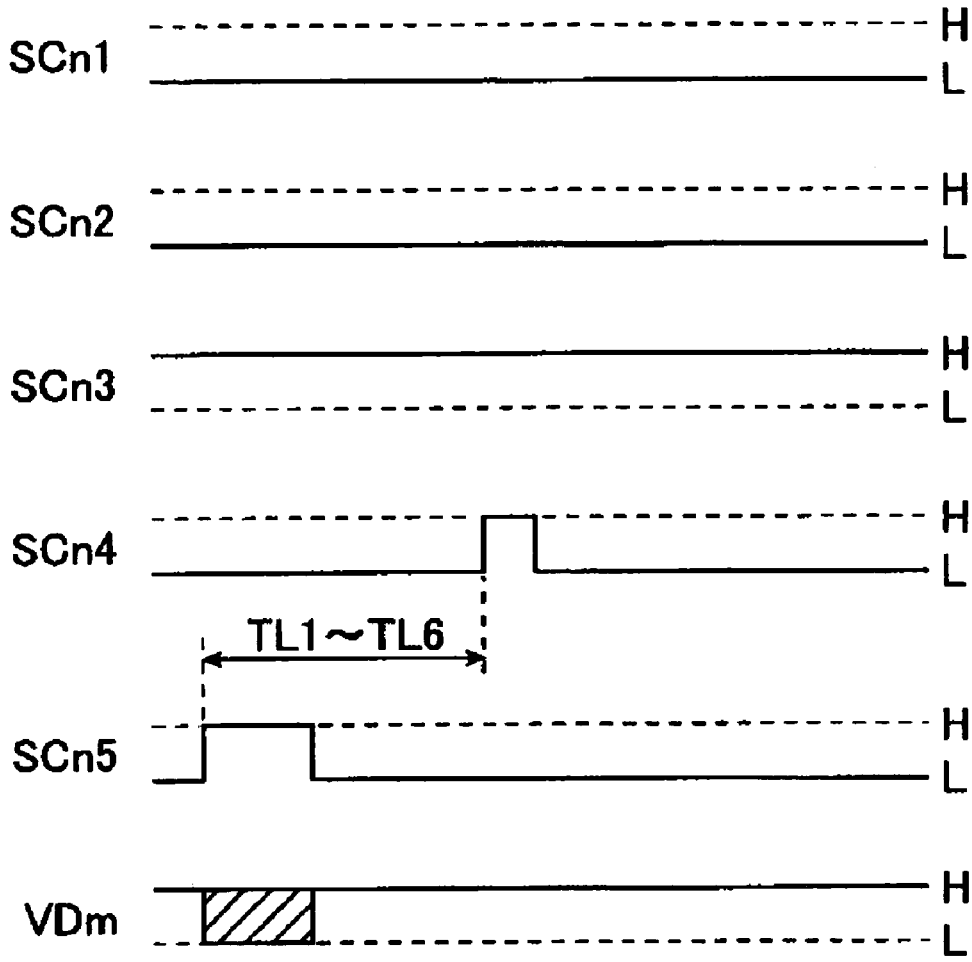
FIG. 10 is a timing chart for explaining selection of a scanning line for exercising time-division gray scale in the third exemplary embodiment.

Referring to FIG. 10, the period-controlling transistor Q44 is kept turned on. The second switching transistor Q42 and the compensating transistor Q45 are kept turned off.

In this state, the first switching transistor Q41 is turned on based on a fifth scanning signal SCn5 at H level, whereby digital data VDm is supplied to the hold capacitor C1 via the data line Xm.

Similar to the exemplary embodiments described earlier, the digital data VDm is used to set either a minimum value or a maximum value (or a lower limit and an upper limit) of the luminance of the organic EL element 21, that is, data to set the resistance of the driving transistor Q3 to either a minimum value or a maximum value.

The driving transistor Q3 is controlled so as to be turned on or off based on the digital data VDm accumulated. When the driving transistor Q3 is on, a driving current is supplied to the organic EL element 21, causing emission of light. On the other hand, when the driving transistor Q3 is off, a driving current is not supplied to the organic EL element 21.

Then, when a fourth scanning signal SCn4 that causes the resetting transistor Q5 to be turned on is output to the fourth sub-scanning line Yn4 at a timing based on the sub-frames SF1 to SF6, the resetting transistor Q5 that has been off is now turned on. When the resetting transistor Q5 is turned on, the power-supply voltage VOEL is applied from the power-supply line L1 to the hold capacitor C1 via the resetting transistor Q5, whereby the gate of the driving transistor Q3 is pulled to the potential of the power-supply voltage VOEL.

When the hold capacitor C1 is reset, the driving transistor Q3 is turned off, whereby the organic EL element 21 that has been emitting light based on the digital data VDm now quits emitting light. Then, a light-emitting operation to be executed next is waited for.

In the pixel circuit 20, analog gray scale is exercised in the following manner.

Figure 11:
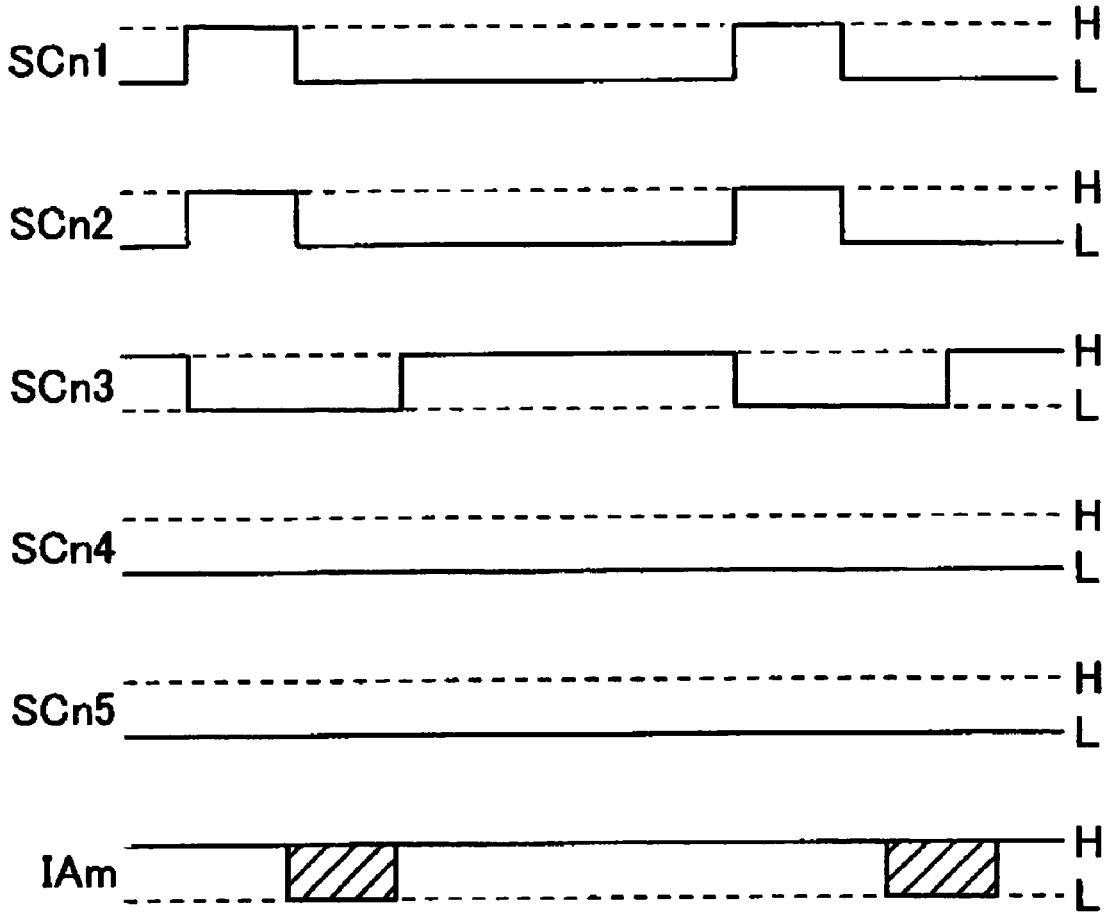
FIG. 11 is a timing chart for explaining selection of a scanning line for exercising analog gray scale in the third exemplary embodiment.

Referring to FIG. 11, the resetting transistor Q5 is kept turned off based on a fourth scanning signal SCn4 at L level. The second switching transistor Q42, the period-controlling transistor Q44, and the compensating transistor Q45 are controlled so as to be turned on and off at prescribed timings, whereby analog gray scale is exercised.

That is, when the second switching transistor 42 and the compensating transistor Q45 are turned on while the resetting transistor Q5 and the period-controlling transistor Q44 are off, an analog data current IAm passes through the driving transistor Q3. Thus, the gate of the driving transistor Q3 is pulled to a potential corresponding to the analog data current IAm, whereby the conduction state of the driving transistor Q3 is set accordingly.

Then, when the second switching transistor Q42 and the compensating transistor Q45 are turned off and the period-controlling transistor Q44 is turned on, a current in accordance with the conduction state of the driving transistor Q3, set in the preceding step, is supplied to the organic EL element 21.

In this exemplary embodiment, the resetting transistor Q5 is constantly kept turned off in analog gray scale mode. Alternatively, the resetting transistor Q5 may be turned on before a next analog data current IAm is written, thereby terminating a light-emitting period.

Fourth Exemplary Embodiment

Next, an exemplary embodiment of an electronic apparatus including the organic EL display 10 as an electro-optical device according to the first exemplary embodiment will be described with reference to FIGS. 12 and 13. The organic EL display 10 can be applied to various electronic apparatuses, such as mobile personal computers, cellular phones, and digital cameras.

Figure 12:
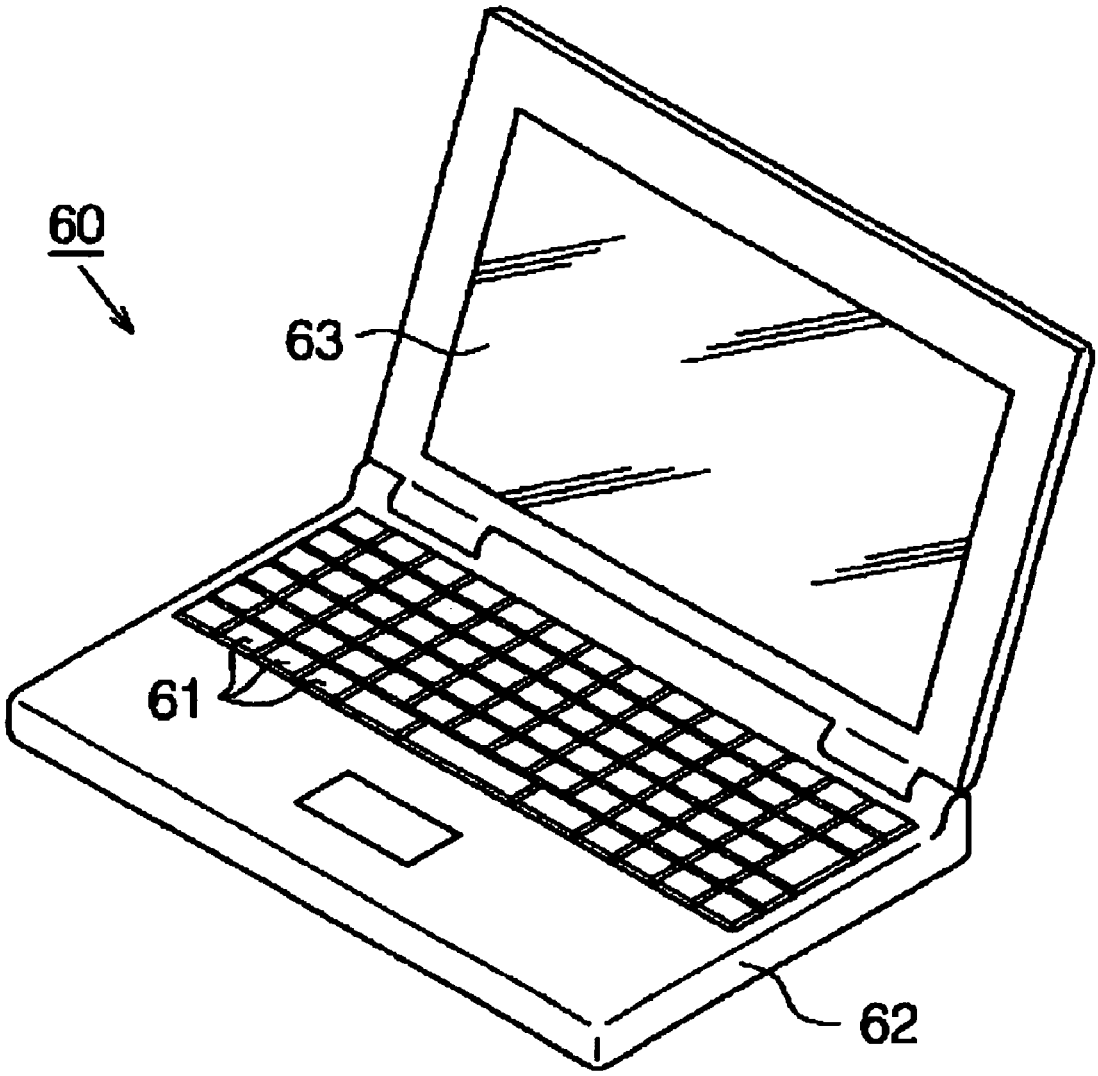
FIG. 12 is a perspective view showing the configuration of a mobile personal computer for explaining a fourth exemplary embodiment.

FIG. 12 is a perspective view showing the configuration of a mobile personal computer. Referring to FIG. 12, a personal computer 60 includes a main unit 62 having a keyboard 61, and a display unit 63 including the organic EL display 10.

Also in this case, the display unit 63 including the organic EL display 10 exhibits the same advantages as in the exemplary embodiments described earlier. Thus, the personal computer 60 simultaneously achieves low power consumption and adequate display quality.

Figure 13:
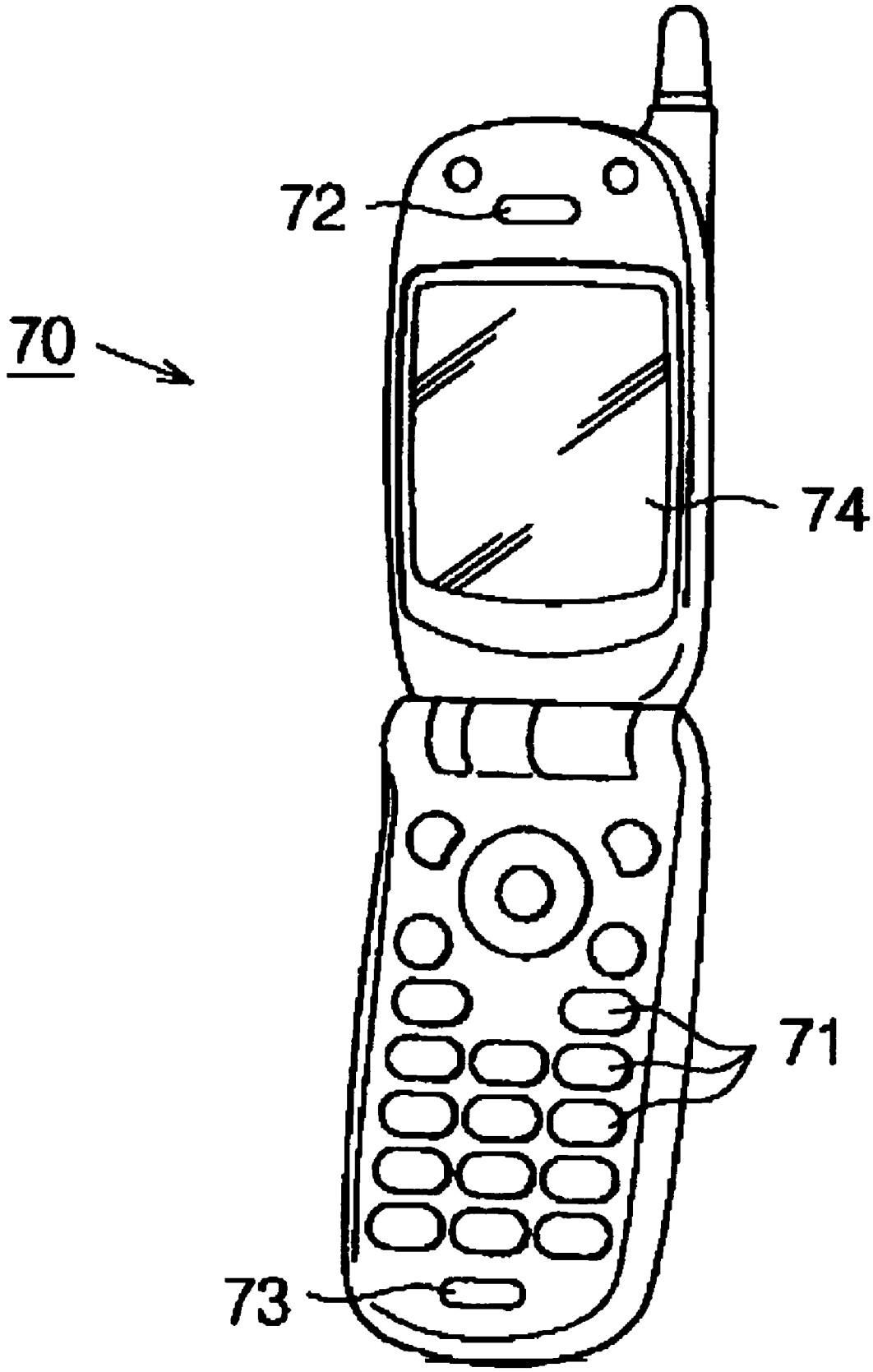
FIG. 13 is a perspective view showing the configuration of a cellular phone for explaining the fourth exemplary embodiment.

FIG. 13 is a perspective view showing the configuration of a cellular phone. Referring to FIG. 13, a cellular phone 70 includes a plurality of operating buttons 71, an earpiece 72, a mouthpiece 73, and a display unit 74 including the organic EL display 10. Also in this case, the display unit 74 including the organic EL display 10 exhibits the same advantages as in the exemplary embodiments described earlier. Thus, the cellular phone 70 achieves simultaneously low power consumption and adequate display quality.

In the exemplary embodiments described above, when digital gray scale is exercised, an amount of charge corresponding to voltage data VDm is held in the hold capacitor C1 and the amount of charge accumulated in the hold capacitor C1 is then reset to terminate each sub-frame, thereby setting the length of period of each sub-frame.

Alternatively, the arrangement may be such that a data voltage is written with the potential of an opposing electrode set so that a reverse bias is applied to the organic EL element 21 and a reverse bias is applied to the organic EL element 21 to terminate each sub-frame, thereby setting the length of each sub-frame.

Furthermore, digital gray scale may be implemented by area gray scale. More specifically, with each pixel circuit 20 as a subpixel, a plurality of subpixels is grouped, and half-tones are represented by exercising control so that an appropriate number of subpixels belonging to the group emit light and the other subpixels do not emit light.

In the exemplary embodiments described above, digital data VD1 to VDm and analog data currents IA1 to IAm are supplied to the pixel circuit 20 via the common data lines X1 to Xm. Alternatively, separate data lines may be provided.

In the exemplary embodiments described above, favorable advantages are achieved using the pixel circuit 20 as an electronic circuit. Alternatively, the present invention may be applied to an electronic circuit to drive an electro-optical element other than the organic EL element 21, for example, an LED, an FED, an electron emission element, or an inorganic EL element.

The invention claimed is:

1. An electronic circuit, comprising:

a first transistor that has a first gate, a first drain and a first source, a conduction state of the first transistor being set in accordance with a current signal supplied to a capacitor during a first period and a voltage signal supplied to the capacitor during a second period, a controller that controls a current outputting circuit and a voltage outputting circuit based on a desired power consumption level, the current outputting circuit outputting the current signal supplied to the capacitor, the voltage outputting circuit outputting the voltage signal supplied to the capacitor, a first current as the current signal flowing through the first transistor during at least a part of the first period, and an amount of charge held in the capacitor being reset to a predetermined state when a second transistor is turned on.

2. The electronic circuit according to claim 1, further comprising:

a third transistor, and the capacitor, the current signal and the voltage signal being supplied to the capacitor through the third transistor, a controller that controls the first circuit and the second circuit based on a desired power consumption level.

3. The electronic circuit according to claim 1, further comprising:

a fourth transistor that controls an electrical connection between the first gate and the first drain.

4. The electronic circuit according to claim 1, further comprising:

a fifth transistor, a second current whose level corresponds to the conduction state of the first transistor set in accordance with the current signal and the voltage signal, the fifth transistor controlling a timing to start or stop a supply of the second current to an electronic element.

5. The electronic circuit according to claim 1, no current flowing through the first transistor during the third period.

6. The electronic circuit according to claim 1, the current signal being a multi-valued data current, and the voltage signal being a binary data voltage.

7. The electronic circuit according to claim 1, further comprising:

an electronic element, a second current whose current level corresponds to the conduction state of the first transistor being supplied to the electronic element.

8. The electronic circuit according to claim 1, the current signal corresponding to analog data current, and the voltage signal corresponding to digital data voltage.

9. The electronic circuit according to claim 1, the conduction state of the first transistor being set in accordance with a current signal supplied to the capacitor during the first period, the first period being a period during which a high luminance is desired, and the conduction state of the first transistor being set in accordance with a voltage signal supplied to the capacitor during a second period, the second period being a period during which a lower luminance is desired.

10. An electro-optical device, comprising:

a plurality of scanning lines;

a plurality of data lines;

a plurality of unit circuits;

a first circuit that outputs a current signal that is accumulated in a capacitor included in each of the plurality of unit circuits;

a second circuit that outputs a voltage signal that is accumulated in a capacitor included in each of the plurality of unit circuits, the second circuit being configured such that a length of a third period in which a conduction state of a first transistor is set in accordance with the voltage signal is changeable, and a second transistor, and an amount of charge held in the capacitor being reset to a predetermined state when the second transistor is turned on, a controller that controls the first circuit and the second circuit based on a desired power consumption level, no current flowing through a transistor included in one unit circuit of the plurality of unit circuits during a second period in which the voltage signal is supplied to the one unit circuit.

11. The electro-optical device according to claim 10, the current signal and voltage signal being supplied to each of the plurality of unit circuits through one data line of the plurality of data lines.

12. The electro-optical device according to claim 10, the plurality of data lines including first data lines and a plurality of second data lines, the current signal being supplied to each of the plurality of unit circuits through one first data line of the plurality of first data lines, and the voltage signal being supplied to each of the plurality of unit circuits through one second data line of the plurality of second data lines.

13. An electronic apparatus, comprising:

the electro-optical device according to claim 10.

14. The electro-optical device according to claim 10, each of the plurality of unit circuits including an electro-optical element.

15. The electro-optical device according to claim 14, the electro-optical element being an EL element.

16. The electro-optical device according to claim 15, the EL element including a light-emitting layer that is composed of an organic material.

17. The electro-optical device according to claim 10, the current signal corresponding to analog data current, and the voltage signal corresponding to digital data voltage.

18. The electro-optical device according to claim 10, further comprising:

a first electrode that is disposed opposite to a plurality of second electrodes, each of which is included in one electro-optical element of a plurality of electro-optical elements included in the plurality of unit circuits.

19. The electro-optical device according to claim 18, a potential of the first electrode being set at a constant during at least a part of a first period in which the current signal is supplied to the capacitor, and the potential of the first electrode being set at the constant during at least a part of a second period in which the voltage signal is supplied to the capacitor.

20. The electronic circuit according to claim 10, the conduction state of the first transistor being set in accordance with a current signal supplied to the capacitor during the first period, the first period being a period during which a high luminance is desired, and the conduction state of the first transistor being set in accordance with a voltage signal supplied to the capacitor during a second period, the second period being a period during which a lower luminance is desired.

21. An electronic circuit, comprising:

a capacitor that accumulates a current signal that is received by the electronic circuit during a first period, the capacitor accumulating a voltage signal that is received by the electronic circuit during a second period;

a first transistor whose conduction state is set in accordance with an amount of charge accumulated in the capacitor stored during a period selected from the first period and the second period, the first transistor having a first gate, a first drain and a first source, the first transistor supplying a current whose level is determined in accordance with the conduction state to an electronic element, a length of a third period in which no current flows through the first transistor is changeable a second transistor, an amount of charge held in the capacitor being reset to a predetermined state when the second transistor is turned on, and a controller that controls a current outputting circuit and a voltage outputting circuit based on a desired power consumption level, the current outputting circuit outputting the current signal accumulated by the capacitor, the voltage outputting circuit outputting the voltage signal accumulated by the capacitor.

22. The electronic circuit according to claim 21, the current signal corresponding to analog data current, and the voltage signal corresponding to digital data voltage.

23. The electronic circuit according to claim 21, further comprising:

a third transistor, the current signal and the voltage signal being supplied to the capacitor through the third transistor.

24. The electronic circuit according to claim 21, further comprising:

a fourth transistor that controls an electrical connection between the first gate and the first drain.

25. The electronic circuit according to claim 21, the conduction state of the first transistor being set in accordance with a current signal supplied to the capacitor during the first period, the first period being a period during which a high luminance is desired, and the conduction state of the first transistor being set in accordance with a voltage signal supplied to the capacitor during a second period, the second period being a period during which a lower luminance is desired.

26. An electronic circuit, comprising:

a capacitor that accumulates a current signal that is received by the electronic circuit in a first mode, the capacitor accumulating a voltage signal that is received by the electronic circuit in a second mode;

a first transistor whose conduction state is set in accordance with an amount of charge accumulated in the capacitor stored during a mode selected from the first mode and the second mode, the first transistor having a first gate, a first drain and a first source, the first transistor supplying a current whose level is determined in accordance with the conduction state to an electronic element, a length of a period in which no current flows through the first transistor is changeable; and a second transistor an amount of charge held in the capacitor being reset to a predetermined state when the second transistor is turned on, a controller that controls a current outputting circuit and a voltage outputting circuit based on a desired power consumption level, the current outputting circuit outputting the current signal accumulated by the capacitor, the voltage outputting circuit outputting the voltage signal accumulated by the capacitor.

27. The electronic circuit according to claim 26, the current signal corresponding to analog data current, and the voltage signal corresponding to digital data voltage.

28. The electronic circuit according to claim 26, a power consumption in the second mode being lower than a power consumption in the first mode.

29. The electronic circuit according to claim 26, the conduction state of the first transistor being set in accordance with a current signal supplied to the capacitor during the first period, the first period being a period during which a high luminance is desired, and the conduction state of the first transistor being set in accordance with a voltage signal supplied to the capacitor during a second period, the second period being a period during which a lower luminance is desired.

* * * * *